US007675051B2

(12) United States Patent
Ohta et al.

(10) Patent No.: US 7,675,051 B2
(45) Date of Patent: Mar. 9, 2010

(54) SHEET DETECTOR MECHANISM INCLUDING SHEET DETECTOR FURTHER INCLUDING PHOTORECEPTORS, AND IMAGE FORMING APPARATUS INCLUDING THE SAME

(75) Inventors: So Ohta, Tokyo (JP); Masataka Shimoohsako, Tokyo (JP); Noriaki Fukube, Tokyo (JP); Tetsuya Ohfuchi, Tokyo (JP)

(73) Assignee: Ricoh Co., Ltd., Tokyo (JP)

( * ) Notice: Subject to any disclaimer, the term of this patent is extended or adjusted under 35 U.S.C. 154(b) by 651 days.

(21) Appl. No.: 11/642,709

(22) Filed: Dec. 21, 2006

(65) Prior Publication Data

US 2007/0138416 A1 Jun. 21, 2007

(30) Foreign Application Priority Data

Dec. 21, 2005 (JP) ..... 2005-368849

(51) Int. Cl.
*G01N 21/86* (2006.01)

(52) U.S. Cl. ..... 250/559.3; 250/205

(58) Field of Classification Search ..... 250/559.4, 250/559.36, 559.3, 559.27, 559.19, 221, 250/205; 399/45–51, 38; 355/68, 75; 347/248
See application file for complete search history.

(56) References Cited

U.S. PATENT DOCUMENTS 4,945,222 A * 7/1990 Sakai et al. ..... 250/205

FOREIGN PATENT DOCUMENTS

| | | |
|---|---|---|
| JP | 04-323146 | 11/1992 |
| JP | 07-041208 | 2/1995 |
| JP | 08-171266 | 7/1996 |
| JP | 2003-285472 | 10/2003 |
| JP | 2004-069805 | 3/2004 |
| JP | 2006-082880 | 3/2006 |

* cited by examiner

*Primary Examiner*—Que T Le
(74) *Attorney, Agent, or Firm*—Harness, Dickey & Pierce, P.L.C.

(57) ABSTRACT

An image forming apparatus includes an image forming mechanism, a sheet conveyance mechanism, and a sheet detector. The image forming mechanism forms an image and transfers it onto the sheet conveyed by the sheet conveyance mechanism. The sheet detector is arranged upstream from an image transfer region and configured to detect the sheet. The sheet detector includes a light source, a plurality of photoreceptors, and a controller. The plurality of photoreceptors is arranged in line in a main-scanning direction and includes a first photoreceptor group and a second photoreceptor group. The first photoreceptor group changes output voltages when overridden by the side edge of the sheet. The second photoreceptor group includes an opposite end of the plurality of photoreceptors being out of the side edge of the sheet. The controller is configured to adjust a light emission amount in accordance with characteristics of the sheet.

14 Claims, 8 Drawing Sheets

SHEET DETECTOR MECHANISM INCLUDING SHEET DETECTOR FURTHER INCLUDING PHOTORECEPTORS, AND IMAGE FORMING APPARATUS INCLUDING THE SAME

BACKGROUND

1. Field

Example embodiments generally relate to a sheet detector, a sheet detector mechanism and an image forming apparatus, for example, to an image forming apparatus including a sheet detector capable of detecting a position of a sheet.

2. Discussion of the Background

In general, a background image forming apparatus, for example, a copying machine, a printer, a facsimile machine, and a so-called multifunction printer, includes an image forming mechanism for forming an image, e.g., a toner image, and a sheet conveyance unit for conveying a recording sheet, e.g., a paper sheet, to the image forming mechanism.

These machines have recently been provided with a versatility of handling a variety of differently-sized recording sheets in order meet a market demand. For example, background image forming apparatus may be equipped with a plurality of sheet containers for containing various kinds and/or sizes of recording sheets.

Such enhancement of the recording sheet handling, however, may increase a number of sheet conveyance paths provided in the sheet conveyance unit, each to reach a common region in which an image is transferred from the image forming mechanism to the recording sheet. If the sheet conveyance paths have greater tolerances relative to the common region, a position for an image transferred on a recording sheet may inevitably vary depending upon the kinds and/or sizes of the recording sheets.

If an image transfer positioning relative to the recording sheets conveyed by is not accurate, the recording sheets may have uneven margins or a partly-cut-off image. Further, if a stack of recording sheets having such uneven margins is subjected to a book-binding-like process, a part of the images may be cut off.

SUMMARY

In example embodiments, an image forming apparatus may include an image forming mechanism, a sheet conveyance mechanism, and/or a sheet detector. The sheet conveyance mechanism may be configured to convey a sheet through a sheet conveyance passage. The image forming mechanism may be configured to form an image and to transfer the image at an image transfer region onto the sheet conveyed by the sheet conveyance mechanism. The sheet detector may be arranged upstream from an image transfer region in a sheet conveyance direction and configured to detect the sheet. The sheet detector may include a light source for emitting light, a plurality of photoreceptors, and/or a controller. The plurality of photoreceptors may be arranged in a line in a main-scanning direction with space at substantially equal intervals to extend across a sheet skew marginal width and to evenly receive the light from the light source. The plurality of photoreceptors may include a first photoreceptor group and a second photoreceptor group. The first photoreceptor group may be configured to be overridden by a side edge of the sheet passing through the sheet conveyance passage and to change output voltages when overridden by the side edge of the sheet. The second photoreceptor group is connected to the first photoreceptor group and includes an opposite end of the plurality of photoreceptors being out of the side edge of the sheet. The controller, which may be part of a sheet detector mechanism, may be configured to adjust a light emission amount of the light source in accordance with characteristics of the sheet to maintain the output voltages of the plurality of photoreceptors, regardless of the characteristics of the sheet.

In example embodiments, a sheet detector mechanism may include a sheet detector including a light source emitting light and a plurality of photoreceptors arranged in a line in a main-scanning direction spaced at substantially equal intervals to extend across a sheet skew marginal width and to evenly receive light from a light source, the plurality of photoreceptors including a first photoreceptor group overridable by a side edge of the sheet passing through a sheet conveyance passage and a second photoreceptor group connected to the first photoreceptor group and including an opposite end of the plurality of photoreceptors being out of the side edge of the sheet, the first photoreceptor group changing output voltages when overridden by the side edge of the sheet; and a controller configured to adjust a light emission amount of the light source in accordance with characteristics of the sheet so as to maintain the output voltages of the plurality of photoreceptors, regardless of the characteristics of the sheet.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF EXAMPLE EMBODIMENTS

Figure 1:
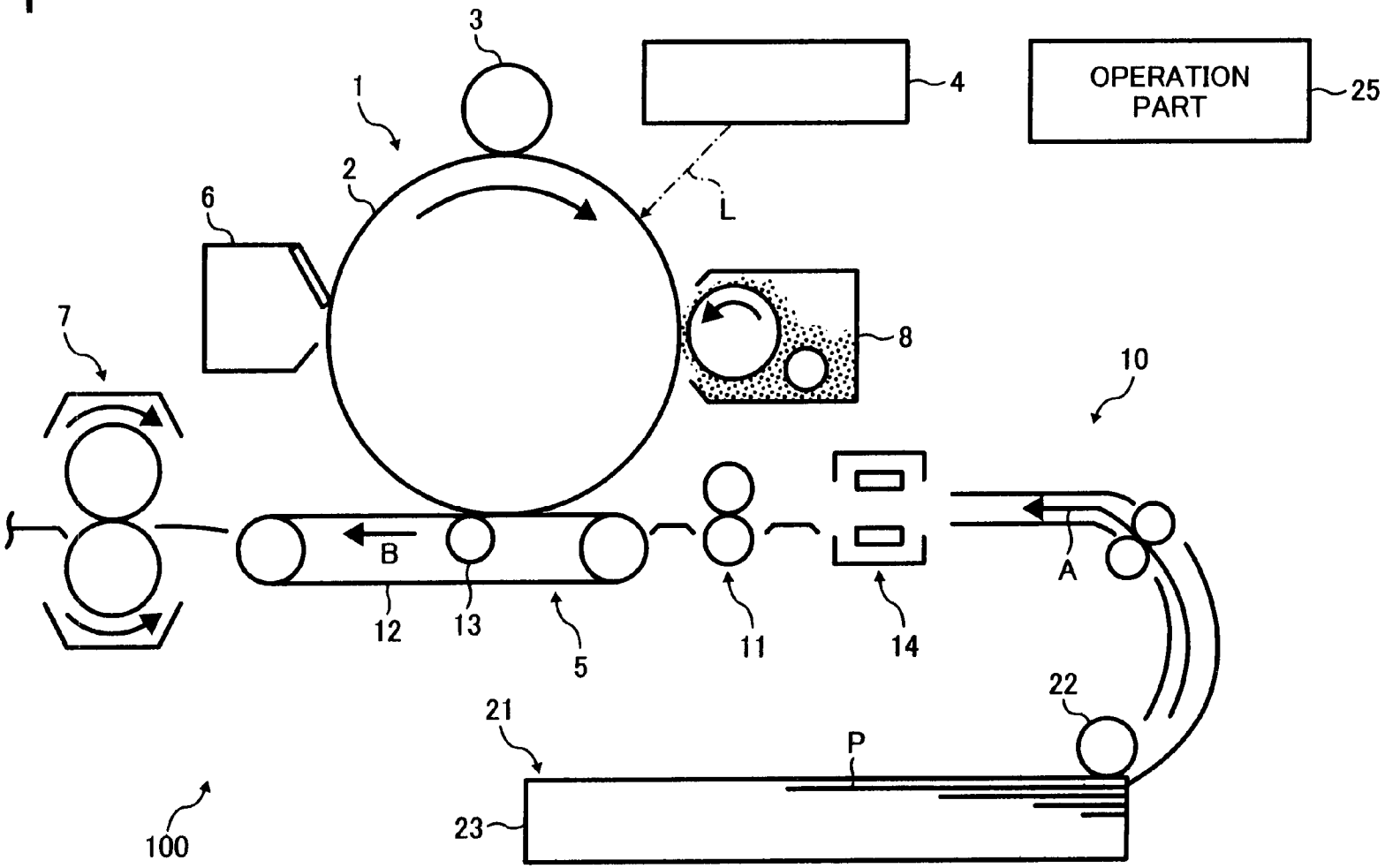
FIG. 1 is a schematic diagram of an image forming apparatus according to example embodiments.

In describing example embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner. Referring now to the drawings, wherein like reference numerals designate identical or corresponding parts throughout the several views, particularly to FIG. 1, an image forming apparatus 100 according to example embodiments is described.

The image forming apparatus 100 may be a copier, a printer, a facsimile machine, or a multifunction peripheral (MFP) having at least two of the above functions. As illustrated in FIG. 1, the image forming apparatus 100 may include an image forming mechanism 1, a sheet conveyance unit 10, a pair of registration rollers 11, a sheet detector 14, and/of an operation part 25. The sheet detector 14 may be provided upstream of the image forming mechanism 1 in a sheet conveyance direction and may detect a position of a recording sheet transported by the sheet conveyance unit 10. The sheet conveyance unit 10 may include a sheet feeder 21 that may be provided beneath the image forming mechanism 1.

The image forming mechanism 1 may form an image on a recording sheet and may include an image carrier 2, a charging device 3, an exposure device 4, a transfer unit 5, a cleaning device 6, a fixing unit 7, and/or a developing unit 8. The sheet feeder 21 may a supply sheet P as a recording sheet and include a feeding roller 22 to forward the sheet P and a sheet cassette 23 to store a plurality of sheets P. The transfer unit 5 may include a transfer belt 12 and a transfer roller 13. The transfer belt 12 may be stretched around a plurality of rollers and rotate in a direction of arrow B.

The image carrier 2 may be a drum-shaped photoconductor. In an image forming process, the image carrier 2 may rotate clockwise in FIG. 1. The charging device 3 may charge a surface of the image carrier 2 with a predetermined or given polarity. The exposure device 4 may irradiate the charged surface with a laser beam L to form an electrostatic latent image. The laser beam L may be optically modulated. The developing unit 8 may develop the electrostatic latent image with a toner into a toner image.

In the sheet feeder 21, the feeding roller 22 may be in contact with a sheet P that is on the top in the sheet cassette 23. The sheets P may be sent out from the top when the feeding roller 22 rotates. The sheet conveyance unit 10 may transport the sheet P in the direction of arrow A to the pair of registration rollers 11. The sheet P may be stopped when its front edge is sandwiched between the registration rollers 11. The registration roller 11 may rotate at a predetermined or desirable timing to send the sheet P to a space between the image carrier 2 and the transfer belt 12.

The transfer belt 12 may be charged by the transfer roller 13. While the sheet P is conveyed by the transfer belt 12, the toner image on the image carrier 2 may be transferred onto the sheet P by the effect of the transfer voltage. The cleaning device 6 may remove a toner remains on the image carrier 2 after the transfer process. The fixing unit 7 may fix the toner image on the sheet P.

In addition to the sheet feeder 21 illustrated in FIG. 1, a manual sheet feeder to forward sheets that are manually put therein by an operator and/or a large capacity sheet feeder may be provided.

The operation part 25 may be provided on a top of the image forming apparatus 100 for an operator to select functions and/or to input settings.

The sheet detector 14 may detect a position of the sheet P in the direction perpendicular to the sheet conveyance direction, in other words, in the width direction of the sheet P, to enhance positional accuracy of an image relative to the sheet P. In FIG. 1, the sheet detector 14 may be provided upstream of a transfer region, where the toner image on the image carrier 2 is transferred onto the sheet P in the sheet conveyance direction as an example.

Based on the result of detection by the sheet detector 14, a starting point for the exposure device 4 to irradiate the image carrier 2 in the main-scanning direction may be corrected. An electrostatic latent image formed on the image carrier 2 may be developed as a toner image by the developing unit 8. The toner image may be transferred onto the sheet P. Thus, the position of image relative to the sheet P may be corrected based on the result of detection by the sheet detector 14.

The sheet detector 14 is described in detail with reference to FIG. 2. The sheet detector 14 may be a transmission detector and include a light emission part 15, a photoreceptor part 16, and/or a controller 40. The sheet detector 14 may be connected to the operation part 25. The light emission part 15 may include a light emission element 17 as a light source, and a light guide 18.

The photoreceptor part 16 may include a photoreceptor row 19 in which a plurality of photoreceptor elements 20 is arranged in line in a main-scanning direction that is perpendicular to the sheet conveyance direction at substantially constant intervals to extend across a sheet skew marginal width. Each of the photoreceptor elements 20 may be configured to evenly receive light from the light emission element 17. The photoreceptor row 19 may include photoreceptor element 20*g* provided at one end thereof (first end) and a photoreceptor element 20*h* at the other end thereof (second end). In FIG. 2, the photoreceptor element row 19 may be divided in photoreceptor element groups 20*a* and 20*b*. Although the light emission part 15 may include one light emission element 17 as an example, the light emission part 15 may include a plurality of light emission elements.

Figure 2:
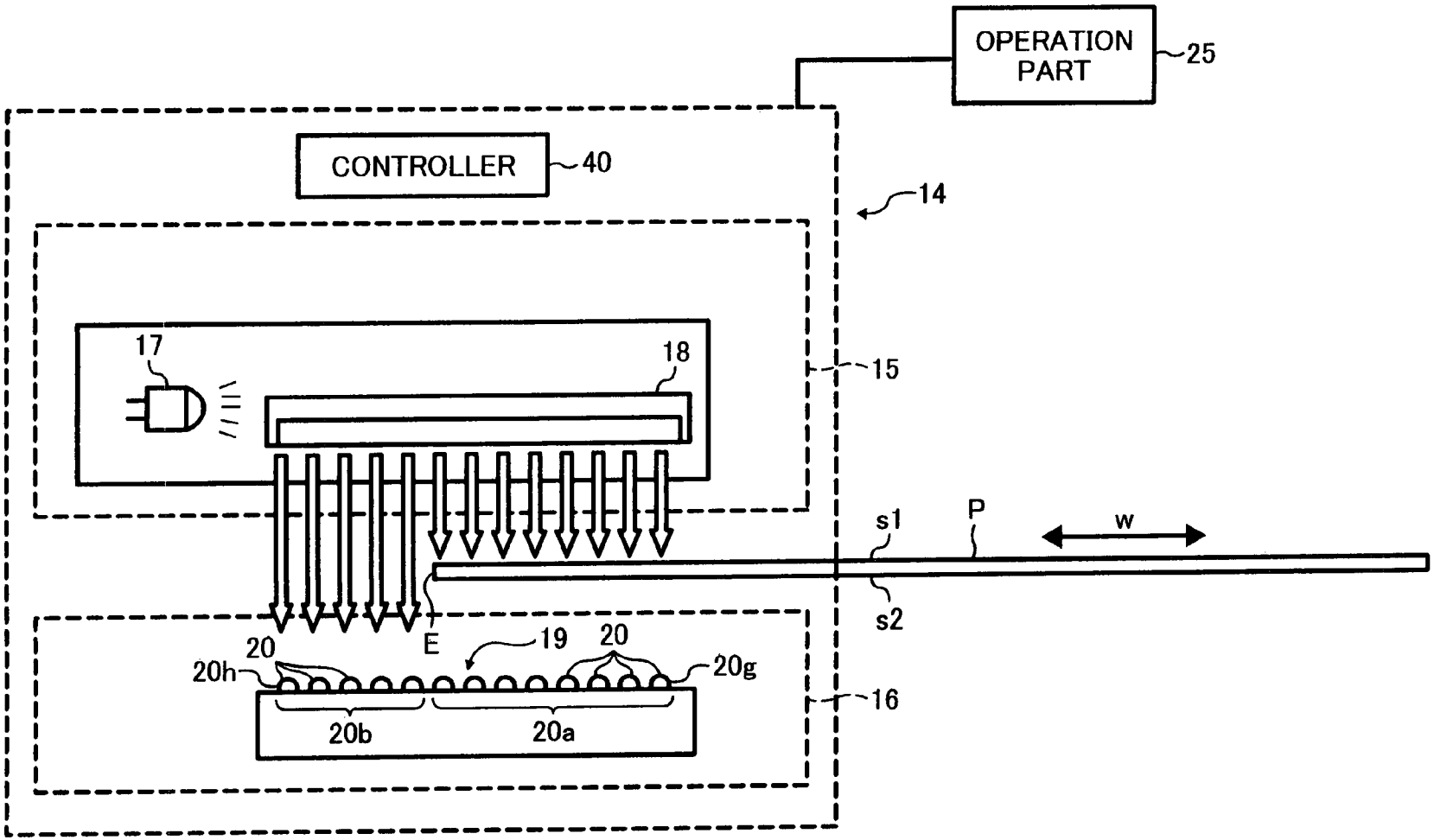
FIG. 2 is an illustration to explain a transmission sheet detector according to example embodiments.

FIG. 2 illustrates a situation in which the sheet P reaches the sheet detector 14 and a width direction of the sheet P is shown by arrow w. The sheet P may be conveyed in a vertical direction relative to a surface of FIG. 2. The sheet P may include a first surface s1, a second surface s2, and an edge E.

The light emission part 15 may face the first surface s1 and the photoreceptor part 16 may face the second surface s2 of the sheet P.

In FIG. 2, the photoreceptor element group 20*a* may face the sheet P and the photoreceptor element group 20*b* does not face the sheet P. The photoreceptor element 20*h* may be located at a position not facing the sheet P and the photoreceptor element 20*g* may be located at a position facing the sheet P, whatever size the width of the sheet P is.

The light emission element 17 may emit light when the sheet P reaches the sheet detector 14. The light may be guided to the plurality of photoreceptor elements 20 by the light guide 18 as shown by arrows. The plurality of photoreceptor elements 20 may output different voltages corresponding to the amount of light received (output voltage) to the controller 40. The photoreceptor element group 20*b* may receive a larger amount of light than the amount of light received by the photoreceptor element group 20*a*. Therefore, the position of the edge E of the sheet P may be determined based on the output voltages from the plurality of photoreceptor elements 20 corresponding to the amount of light received.

Figure 3:
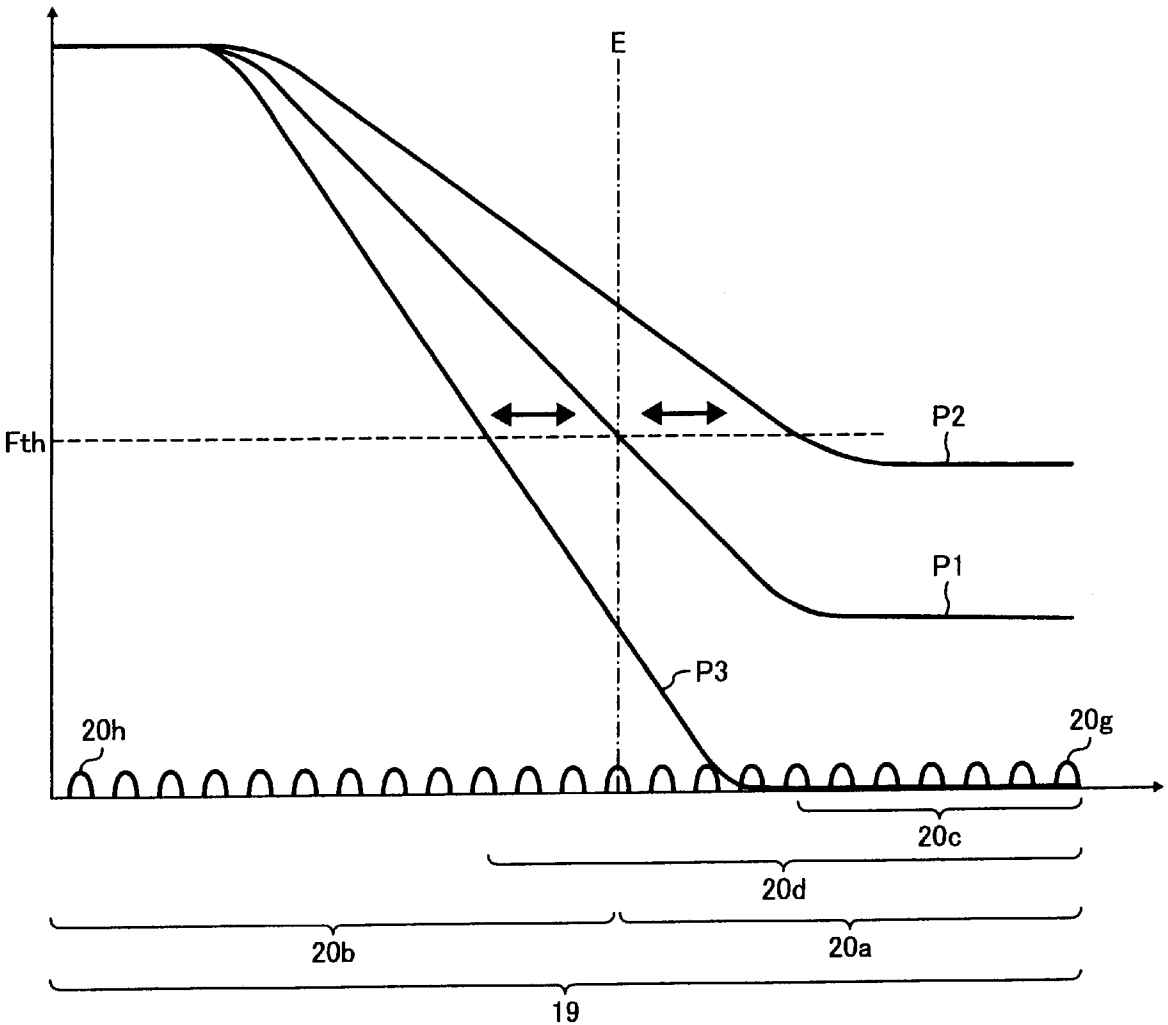
FIG. 3 is an example illustration to explain output voltages of the sheet detector of FIG. 3.

FIG. 3 is an illustration to explain output voltages from the plurality of photoreceptor elements 20 included in the sheet detector 14 illustrated in FIG. 2. In FIG. 3, the photoreceptor element row 19 is illustrated along a horizontal axis and a vertical axis illustrates output voltages from the plurality of photoreceptor elements 20. The photoreceptor element row 19 may include photoreceptor element groups 20*a*, 20*b*, 20*c*, and 20*d*.

The output voltages from the plurality of photoreceptor elements 20 were measured when positions in width direction of sheets P having different thickness were detected by the sheet detector 14. Each of the lines P1, P2, and P3 indicates the output voltages from the plurality of photoreceptor elements 20 when the sheet P was a normal paper (P1), a thin paper (P2), or a cardboard (P3).

As illustrated in FIG. 3, the output voltages from the photoreceptor element group 20*a* facing the sheet P is smaller than the output voltages from the photoreceptor element group 20*b* not facing the sheet P. Therefore, the position of the edge E of the sheet P may be detected by preliminary setting a threshold Fth of output voltage from the photoreceptor elements 20. In FIG. 3, the threshold Fth may be set when the sheet P is the normal paper.

The controller 40 may set a detection condition and determine whether or not the output voltage is equal to or less than the threshold Fth when the light emission element 17 emits light. The controller 40 may determine that the sheet P exists at the position facing the photoreceptor element 20 in the photoreceptor element group 20*a* whose output voltage is equal to or less than the threshold Fth. Therefore, the controller 40 may detect the position of the sheet P in width direction and determine the position of its edge E.

However, the amounts of light received by the photoreceptor elements 20 may differ depending on differences in characteristics, for example, thickness, of the sheet P. The thin paper may transmit more light than the normal paper, and the cardboard may transmit less light than the normal paper. Accordingly, the output voltages from the photoreceptor elements 20 may differ. For example, the output voltage from the photoreceptor group 20*c* is smaller than the threshold Fth when the sheet is the thin paper, as illustrated in FIG. 3. Similarly, the output voltage from the photoreceptor group 20*d* may be smaller than the threshold Fth when the sheet is the thick cardboard. The above problem may be solved by adjusting the amount of light emission.

Figure 4:
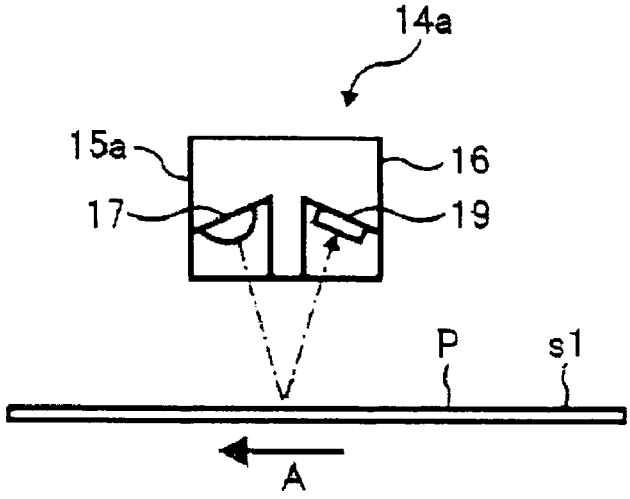
FIG. 4 is an illustration to explain a reflection sheet detector according to example embodiments.

The sheet detector according to example embodiments may be a reflection detector. FIG. 4 illustrates a sheet detector 14*a* that is a reflection detector. The sheet detector 14*a* may include a light emission part 15*a* and a photoreceptor part 16. The light emission part 15*a* may include at least one light emission element 17. The photoreceptor part 16 may include a photoreceptor element row 19. In the sheet detector 14*a*, the light emission part 15*a* and the photoreceptor part 16 may be provided at a same side of the sheet P (side of surface s1 in FIG. 4), unlike the sheet detector 14 illustrated in FIG. 2.

FIG. 4 illustrates a situation in which the sheet P is conveyed in the direction of arrow A and reaches the sheet detector 14*a*. When the sheet P reaches the sheet detector 14*a*, the light emission element 17 may emit light to the sheet P. The photoreceptor element row 19 may receive the light reflected by the sheet P.

Figure 5:
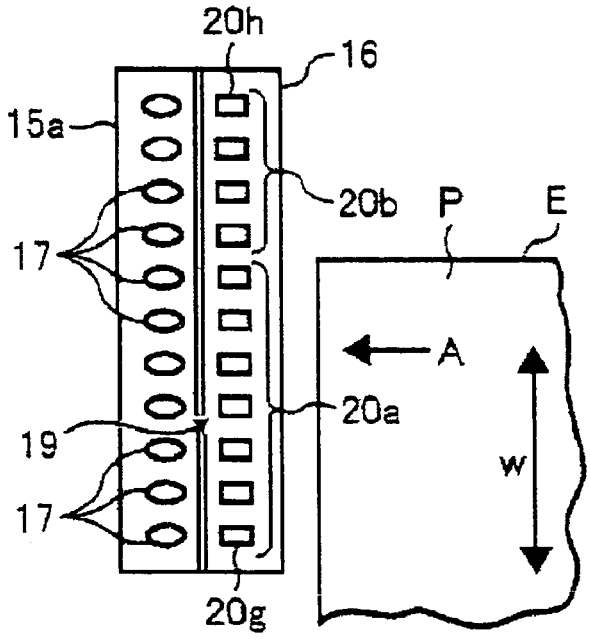
FIG. 5 is an example illustration to explain a light emission part and a photoreceptor part included in the sheet detector of FIG. 4.

FIG. 5 illustrates the light emission part 15*a* and photoreceptor part 16 of the sheet detector 14*a* in detail. The photoreceptor element row 19 may include a plurality of photoconductor elements 20 lined at a substantially constant intervals in a main-scanning direction that is perpendicular to the sheet conveyance direction shown by arrow A. The photoreceptor element row 19 may include a photoreceptor element group 20*a* facing the sheet P and the photoreceptor element group 20*b* not facing the sheet P. The photoreceptor element groups 20*a* and 20*b* may include photoreceptor elements 20*h* and 20*g*, respectively. The photoreceptor element 20*h* may be located at a position not facing the sheet P and the photoreceptor element 20*g* is located at a position facing the sheet P, whatever size the width of the sheet P is. The photoreceptor element group 20*a* may receive a larger amount of light than the amount of light received by the photoreceptor element group 20*b*, contrary to the sheet detector 14 illustrated in FIG. 2.

Figure 6:
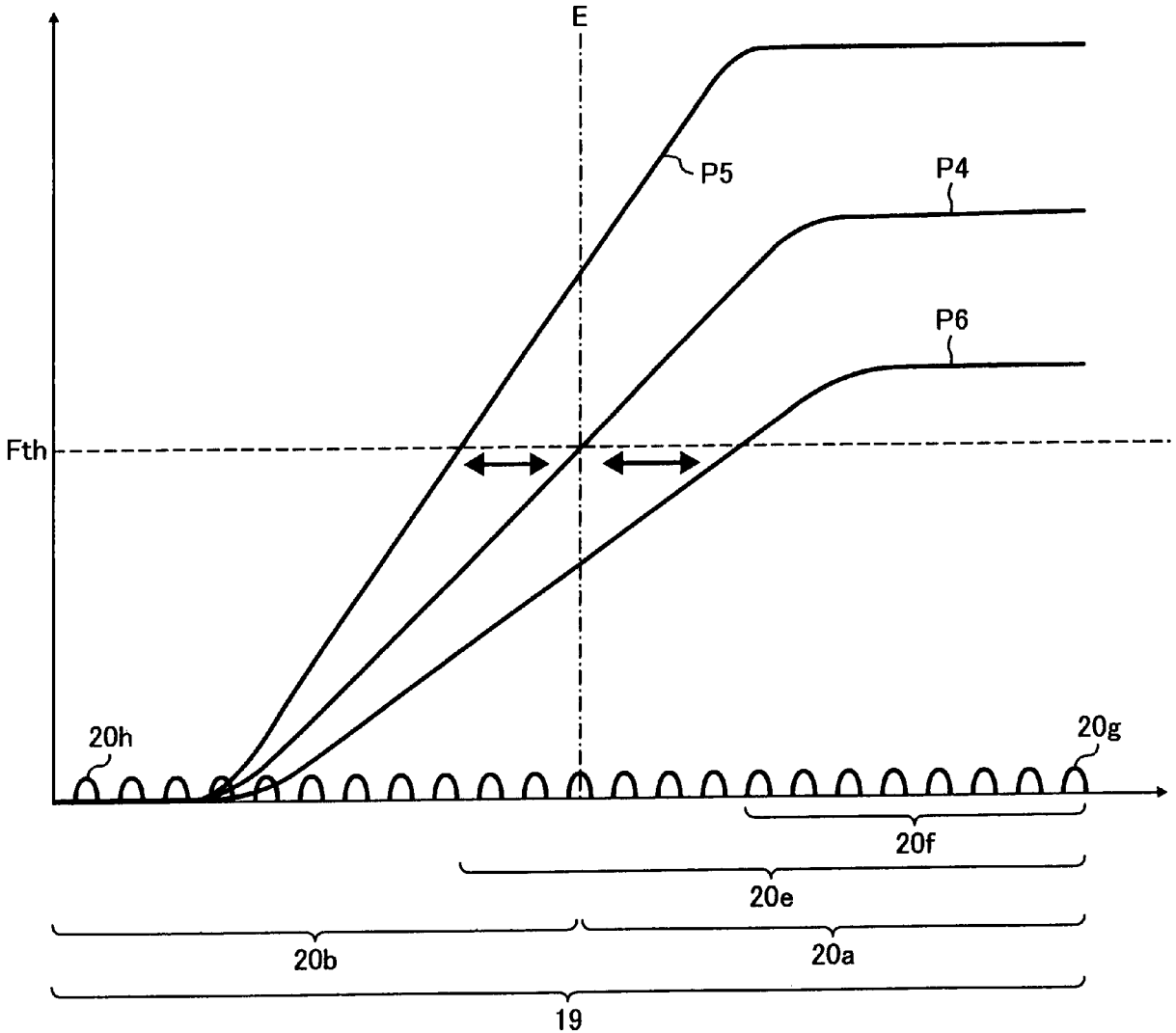
FIG. 6 is an example illustration to explain output voltages of the sheet detector of FIG. 4.

FIG. 6 is an illustration to explain output voltages from the plurality of photoreceptor elements 20 included in the sheet detector 14*a* illustrated in FIG. 4. In FIG. 6, the photoreceptor element row 19 is illustrated along a horizontal axis and a vertical axis illustrates output voltages from the plurality of photoreceptor elements 20. The photoreceptor element row 19 may include photoreceptor element groups 20*a*, 20*b*, 20*e*, and 20*f*.

The output voltages from the plurality of photoreceptor elements 20 were measured when sheets P having different reflectivity were conveyed to the sheet detector 14*a* and the light emission part 15*a* emits light. Each of the lines P4, P5, and P6 indicates the output voltages when the sheet P was a normal paper (P4), a light-colored paper (P5), or a dark-colored paper (P6). The light-colored paper is likely to reflect more light than the amount of light reflected by the normal paper. The dark-colored paper is likely to reflect less light than the amount of light reflected by the normal paper.

The output voltages of light received by the photoreceptor element group 20*a* facing the sheet P are larger than the output voltages from the photoreceptor element group 20*b* not facing the sheet P, as illustrated in FIG. 6. Therefore, the position of the edge E of the sheet P may be detected by preliminary setting a threshold value Fth of output voltage.

In FIG. 6, the threshold Fth is set when the sheet P is the normal paper. When the light emission element 17 emits light, the controller 40 may determine that the sheet P exists at the position facing the photoreceptor element 20 in the photoreceptor element group 20*a* whose output voltage is equal to or greater than the threshold Fth. Therefore, the controller 40 may detect the position of the sheet P in width direction and determine the position of its edge E.

The amounts of light received by the photoreceptor elements 20 and the corresponding output voltages thereof may differ depending on difference in light reflectivity of the sheet P. Accordingly, the output voltages from the photoreceptor elements 20 may differ, as illustrated in FIG. 6.

For example, the output voltages from the photoreceptor group 20*e* is greater than the threshold Fth when the sheet is the light-colored paper, as illustrated in FIG. 6. Similarly, the output voltage from the photoreceptor group 20*f* is greater than the threshold Fth when the sheet is the dark-colored paper. The above problem may be solved by adjusting the amount of light emission.

Next, the adjustment of the amount of light emission is described. The light emission element 17 of the sheet detector 14 or 14*a* is capable of adjusting the amount of light emission. The type of sheet may be input from the operation part 25 illustrated in FIG. 1. The controller 40 may receive the input of the type of sheet and serves as a detection condition setter to set detection condition of the sheet detector 14.

Figure 7:
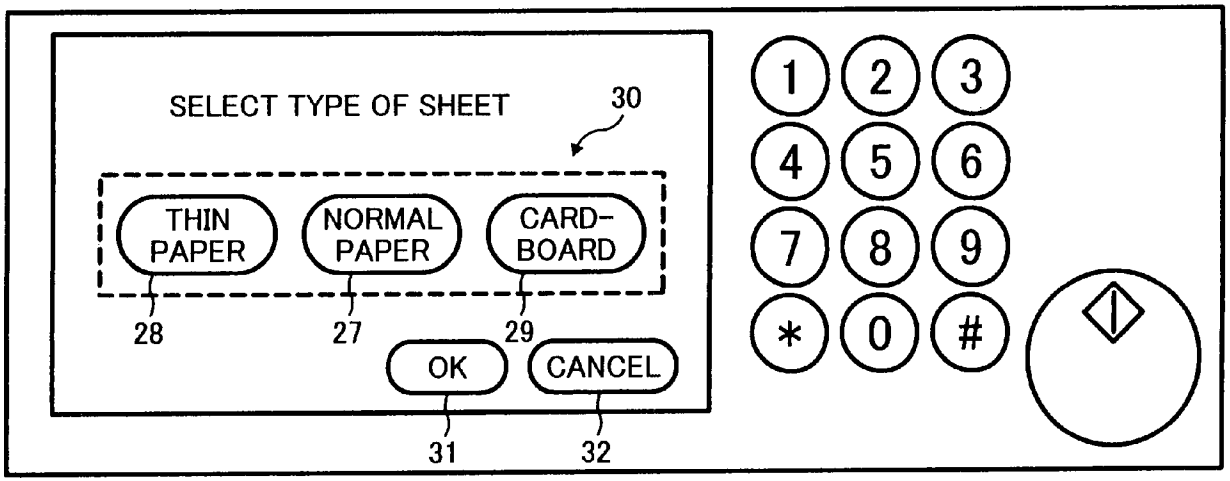
FIG. 7 is an illustration of an example operation part.

FIG. 7 illustrates an example of the operation part 25 when the transmission sheet detector 14 illustrated in FIG. 2 is used. The operation part 25 may include a numeric keypad and a display 26. The display 26 may include a sheet selection part 30 including a normal paper key 27, a thin paper key 28, and a cardboard key 29, an OK key 31, and/or a cancel key 32. The sheet selection part 30 may serve as a sheet type setter according to example embodiments.

When a normal paper (normal thickness) is contained in the sheet cassette 23, an operator pushes the normal key 27 and the OK key 31. The operator may push the cancel key 32 and repeat the selection when a wrong key is pushed. An input signal to set the detection condition may be sent to the controller 40. The controller 40 may send a command to set the amount of light emission to normal. The light emission element 17 may emit normal amount of light when the sheet P being a normal paper is conveyed to the sheet detector 14 when detection condition is set as above. Therefore, the sheet detector 14 may detect the position of the sheet P in the width direction by determining that the sheet P exists the position facing the photoreceptor element 20 in the photoreceptor element group 20*a* whose output voltage is equal to or less than the threshold Fth.

When a thin paper is contained in the sheet cassette 23, the operator may push the thin key paper 28 and the OK key 31. An input signal to set the detection condition may be sent to the controller 40. The controller 40 may send a command to decrease the amount of light emission.

When a cardboard (thick paper) is contained in the sheet cassette 23, the operator pushes the cardboard key 29 and the OK key 31. An input signal to set the detection condition may be sent to the controller 40. The controller 40 may send a command to increase the amount of light emission.

The light emission element 17 may adjust the amount of light to detect the position of the sheet P according to the type of sheet as described above. Therefore, the sheet detector 14 may more accurately detect the position of sheet P in the width direction based on the same threshold Fth, whichever the sheet P is a thin paper, a normal paper, or a cardboard. The amount of light emission may be adjusted so that the each photoreceptor element 20 facing the sheet P outputs the value equal to or less than the threshold value, whichever the type of sheet is.

Figure 8:
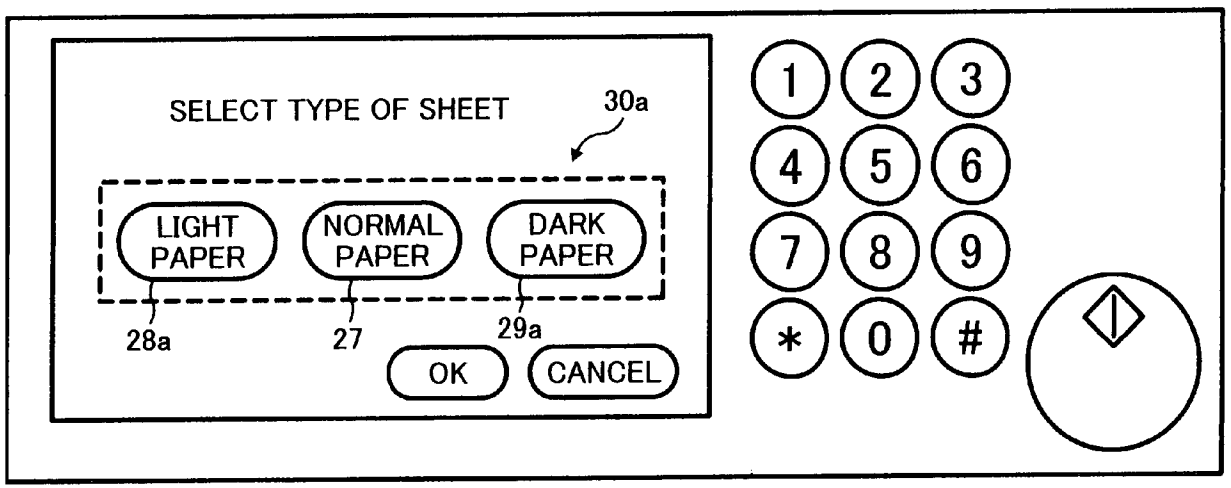
FIG. 8 is an illustration of another example of operation part.

FIG. 8 illustrates another example of the operation part 25 when the reflection sheet detector 14*a* illustrated in FIG. 4 is used. The sheet selection part 30*a* may include a normal paper key 27*a*, a light-colored paper key 28*a*, and/or a dark-colored paper key 29*a*.

The operator may push the normal paper key 27*a* when the sheet P is a normal paper having a normal reflectivity, the light-colored paper key 28*a* when the sheet P is a light-colored paper having a higher reflectivity, or the dark-colored paper key 29*a* when the sheet P is a dark-colored paper having a lower reflectivity. The operator may push the OK key 31. The light emission element 17 may be set to emit a normal amount of light when the sheet P is a normal paper, a decreased amount of light when the sheet P is a light-colored paper, or an increased amount of light when the sheet P is a dark-colored paper.

The sheet detector 14*a* may detect the position of the sheet P in the width direction after the detection condition is set as above. Therefore, the sheet detector 14*a* may correctly detect the position of sheet P in the width direction based on the same threshold Fth, whichever the sheet P is a normal paper, a light-colored paper, or a dark-colored paper. The amount of light emission may be adjusted so that the each photoreceptor element 20 facing the sheet P outputs the value equal to or greater than the threshold value, whichever the type of sheet is.

Whichever the sheet detector according to example embodiments is a reflective detector or a transmission detector, the detection condition according to characteristics of sheet (e.g. thickness and reflectivity) may be set by a detection condition setter to adjust the amount of light emission before the position detection. Therefore, the sheet detector 14 according to example embodiments may detect the position of sheets in its width direction based on the same threshold even if the sheets have differences in characteristics.

In example embodiments, an operator may push a selection key to input the type of sheet. Alternatively, the sheet detector 14 according to example embodiments may detect the type of sheet. For example, the light emission element 17 may emit light to the sheet P. The photoreceptor element 20*g* may receive light penetrating the sheet P in the case of the transmission detector, or light reflected by the sheet P in the case of the reflection detector. The type of sheet (characteristics) may be determined according to the output voltage from the photoreceptor element 20*g*. Alternatively, a detecting device to determine the type of sheet may be provided upstream of the sheet detector 14 in the sheet conveyance direction in FIG. 1.

Next, examples of detection condition setting procedures performed by the sheet detector 14 are described with reference to flowcharts of FIGS. 9 and 10.

Figure 9:
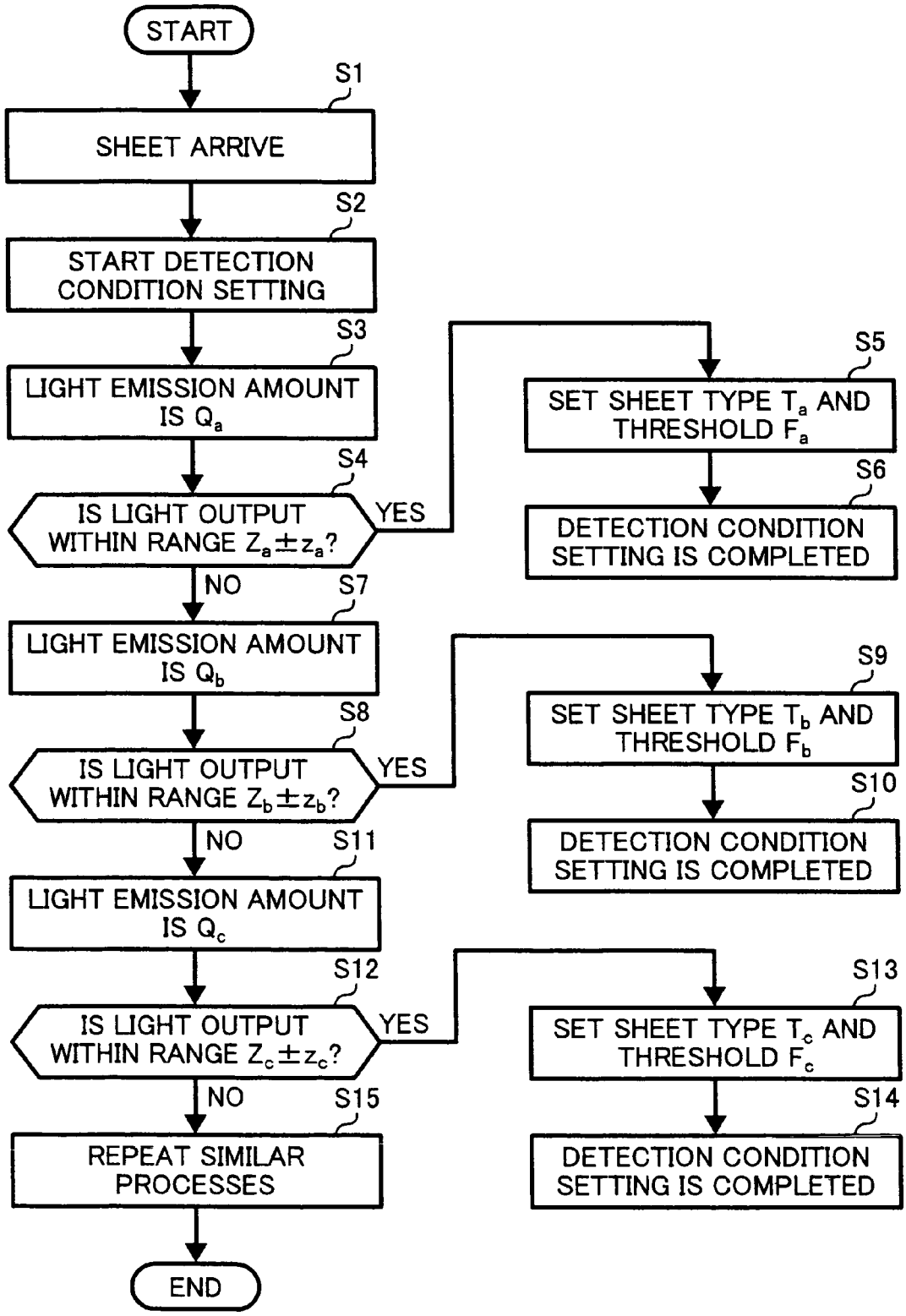
FIG. 9 is a flowchart of an example of a detection condition setting procedure.

Referring to FIG. 9, when a sheet P is sent from the sheet feeder 21 illustrated in FIG. 1 and reaches the sheet detector 14 (S1), the detection condition setting procedure is started (S2). The light emission part 15 may emit a first light to the sheet P. The amount of the first light is defined as $Q_a$ (S3). The photoreceptor elements 20 may receive light penetrating the sheet P. The output voltage from the photoreceptor element 20 facing the sheet P, for example, the photoreceptor element 20*g*, may be defined as $X_a$. A range of output voltage, $Z_a$ plus or minus $z_a$ ($Z_a \pm z_a$), is predetermined to determine whether or not the type of sheet P is type $T_a$. The controller 40 may determine whether or not the output voltage $X_a$ is within the range of $Z_a \pm z_a$ (S4). When the output voltage $X_a$ is within the range of $Z_a \pm z_a$, the sheet P may be judged as the type $T_a$. Accordingly, the threshold Fth may be set to $F_a$ (S5). The detection condition setting procedure may be completed (S6).

The position of sheet P in its width direction may be detected based on the amount of the first light $Q_a$ from the light emission part 15 and the threshold $F_a$ that are set as above.

When the output voltage $X_a$ is not within the range of $Z_a \pm z_a$, the light emission part 15 may emit a second light whose amount is different from the amount of the first light $Q_a$ (S7). The amount of the second light may be defined as $Q_b$. The output voltage from the photoreceptor element 20*g* may be defined as $X_b$. A range of output voltage $Z_b \pm z_b$ is predetermined to judge whether or not the type of sheet P is type $T_b$. The controller 40 may determine whether or not the output voltage $X_b$ is within the range of $Z_b \pm z_b$ (S8). When the output voltage $X_a$ is within the range of $Z_b \pm z_b$, the sheet P may be judged as the type $T_b$. The threshold Fth may be set to $F_b$ (S9). The detection condition setting procedure is completed (S10).

The position of sheet P in its width direction may be detected based on the amount of the second light $Q_b$ from the light emission part 15 and the threshold $F_b$ that are set as above.

Further, when the output voltage $X_b$ is not within the range of $Z_b \pm z_b$, the light emission part 15 may emit a third light whose amount is different from the first light $Q_a$ or second light $Q_b$ (S11). The output voltage from the photoreceptor element 20*g* may be defined as $X_c$. A range of output voltage $Z_c \pm z_c$ is predetermined to judge whether or not the type of sheet P is type $T_c$. The controller 40 may determine whether or not the output voltage $X_c$ is within the range of $Z_c \pm z_c$ (S12). When the output voltage $X_c$ is within the range of $Z_c \pm z_c$, the sheet P may be judged as the type $T_c$ and the threshold Fth is set to $F_c$ (S13). The detection condition setting procedure is completed (S14).

The position of sheet P in its width direction may be detected based on the amount of light $Q_c$ from the light emission part 15 and the threshold $F_c$ that are set in the above setting procedure. The above procedure may be continued and similar processes may be performed as required (S15). The position of sheet P in its width direction may be detected based on another amount of light from the light emission part 15 and another threshold that are set in the continued setting procedure.

Processes performed by the sheet detector 14*a* may be substantially same as in the flowchart of FIG. 9, except that the photoreceptor elements 20 may receive the light reflected by the sheet P instead of the light penetrating the sheet P.

The judgment of the type of sheet is explained more specifically, taking an example in which the amounts of the first, second, and third lights $Q_a$, $Q_b$, and $Q_c$ satisfy the relation of $Q_a<Q_b<Q_c$. When the output voltage $X_a$ is within the range of $Z_a \pm z_a$ at S4, the type $T_a$ is determined as a thin paper at S5. In the case of the sheet detector 14*a*, the type $T_a$ is determined as a light-colored paper. Accordingly, the threshold $F_a$ to detect the position of the sheet P as a thin paper or a light-colored paper may be set.

Alternatively, when the output voltage $X_b$ is within the range of $Z_b \pm z_b$ at S8, the type $T_b$ is determined as normal paper having a normal thickness or normal reflectivity at S9. Accordingly, the threshold $F_b$ to detect the position of the sheet P as a normal paper may be set.

Alternatively, when the output voltage $X_c$ is within the range of $Z_c \pm z_c$ at S12 in FIG. 9, the type $T_c$ is determined as cardboard or dark-colored paper at S13. Accordingly, the threshold $F_c$ to detect the position of the sheet P as a normal paper may be set.

As described above, the controller 40 as the detection condition setter in the above example may cause the light emission part 15 to emit the first, second, and third lights whose amounts are different from each other. The controller 40 may determine whether or not the output voltage of the photoreceptor element 20*g* is within the range of $Z_a \pm z_a$, $Z_b \pm z_b$, or $Z_c \pm z_c$. The controller 40 may judge the type of sheet P based of the determination. The controller 40 may be configured to set the amount of light emission $Q_a$, $Q_b$, or $Q_c$ and the threshold $F_a$, $F_b$, or $F_c$, corresponding to the type of sheet judged as above before the detection of the position of the sheet P.

The amounts of light emission $Q_a$, $Q_b$, and $Q_c$ and the thresholds $F_a$, $F_b$, and $F_c$ may be held in combination. When a sheet P reaches the sheet detector 14, the light emission element 15 may emit every amount of light held and measure corresponding output voltages. The controller 40 may select a combination of amount of light emission and threshold to detect the position of sheet based on the output voltages. A plurality of amounts of light emissions and thresholds may be held as default values corresponding to typical types of sheet including a normal paper, a cardboard, a thin paper, and a semitransparent paper. The amount of light emission and threshold may be appropriately set corresponding to the type of sheet.

In the case of the detection condition setting procedure in FIG. 9, the controller 40 may determine whether or not an output voltage of the photoreceptor element 20*g* is within a predetermined range. The controller 40 may judge the type of sheet based on the range and sets the amount of light emission and the threshold to the values corresponding the type of sheet. Therefore, the threshold value may not be quite accurate.

For example, when the amount of light emission is $Q_a$ at S3 in FIG. 9, appropriate thresholds may be different in both cases in which the output voltages are $Z_a+z_a$ and $Z_a-z_a$. However, the detection condition setter in FIG. 9 may set the threshold to $F_a$, regarding the both output voltage as $Z_a$. Thus, an accurate threshold may not be selected when the output voltage slightly varies from $Z_a$, which may decrease the accuracy of the position detection of sheets.

Therefore, another example of detection condition setting procedure to cope with the above problem is described with reference to the flowchart of FIG. 10. In FIG. 10, processes similar to the processes in FIG. 9 are performed, except for S105-1, S109-1, and S113-1.

The photoreceptor element 20*g* may output an output voltage $X_a$, when the first light whose amount is $Q_a$ is emitted at S103. When the controller 40 determines the output voltage $X_a$ is within the output voltage range of $Z_a \pm z_a$ at S104, the sheet P may be determined to be type $T_a$ and the threshold is set to $F_a$ at S105. When the actual output voltage $X_a$ varies from the center value $Z_a$ of the range of $Z_a \pm z_a$, the controller 40 may adjust the amount of light emission according to the variation at S105-1. The position of the sheet P may be more accurately detected based on the threshold $F_a$.

Likewise, when the actual output voltages $X_b$ and $X_c$ varies from the center values $Z_b$ and $Z_c$ of the predetermined or desired output voltage ranges, the controller 40 may adjust the amounts of light emission according to the variations at S109-1 and S113-1, respectively.

The output voltage of the photoreceptor element 20*g* may be approximated to the target values by adjusting the amounts of the first, second, and third lights $Q_a$, $Q_b$, and $Q_c$ as described above. Therefore, the position of the sheet P may be more accurately detected with the selected threshold $F_a$, $F_b$, or $F_c$. For example, to adjust the amount of first light $Q_a$, an adjustment value $q_a$ is added to and deducted form $Q_a$ and the output voltage is measured. Until the output voltage that is closest to the $Z_a$ is obtained, different adjustment values are added to and deducted from the $Q_a$. As a result, the amount of light emission and the output voltage threshold may be set to more appropriate values corresponding to various types of sheets.

Figure 10:
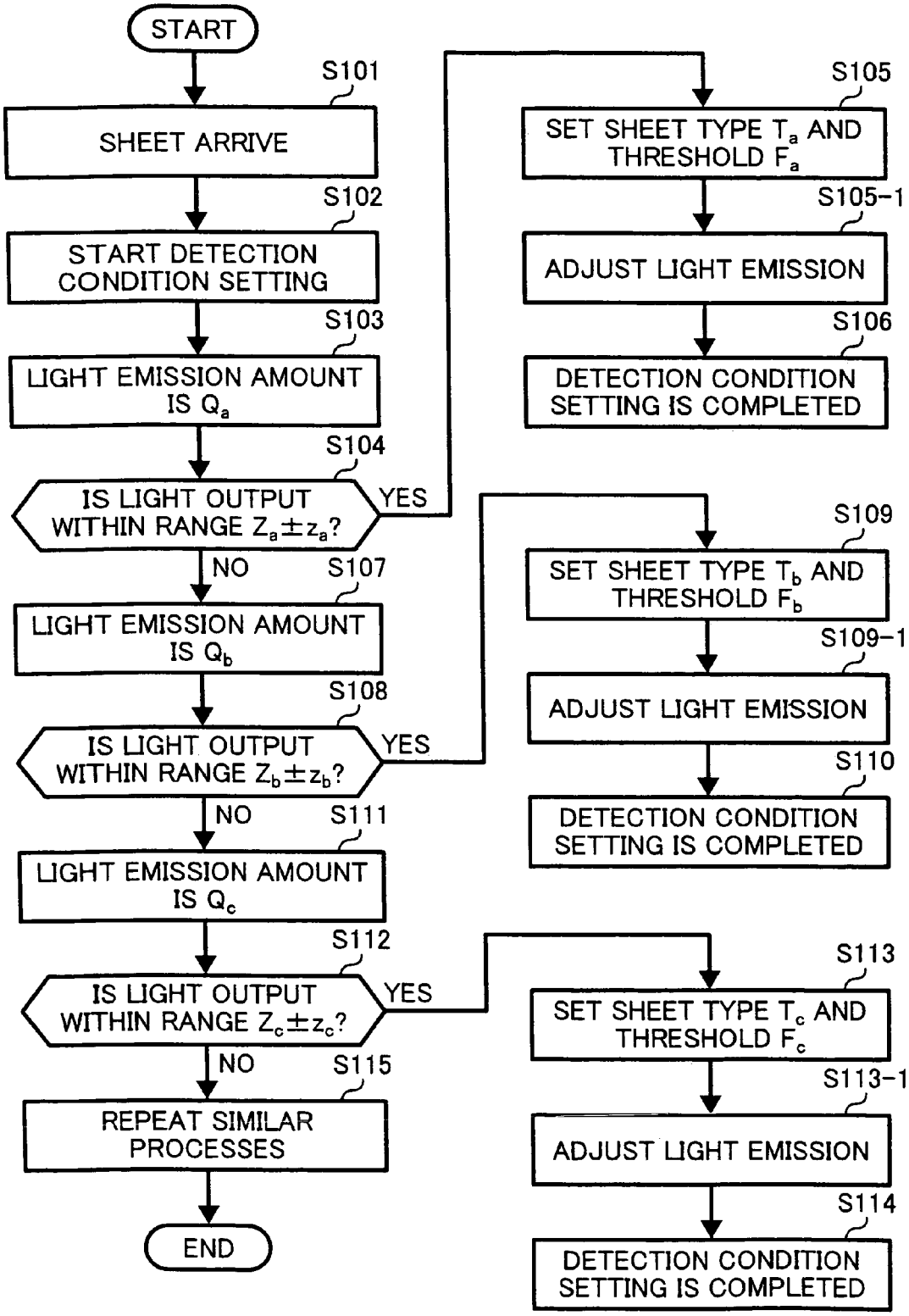
FIG. 10 is a flowchart of another example of a detection condition setting procedure.

An assumption to perform the procedure example of FIG. 10, the amount of light emission may be adjusted according to the difference between X and Z, when the following relation is satisfied:

$$(Z+\Delta Z)>=X=>(Z-\Delta Z)$$

where a predetermined or desirable output voltage range is $Z \pm \Delta Z$, the center value is Z, the allowance in the range is $\Delta Z$, and the actual output voltage is X.

The sheet P may be stopped when its front edge is sandwiched between the registration rollers 11 and kept motionless. In this condition, the detection condition setting procedure in FIGS. 9 or 10 may be performed. In the above situation, the detection conditions may be properly set even if the sheet transport speed is high and/or the sheet P is short in the sheet conveyance direction. Alternatively, the sheet P may be stopped by another member for the sheet detector to perform position detection of the sheet P.

The detection condition setting procedure may be performed for every sheet transported from the sheet feeder 21 illustrated in FIG. 1. However, a complicated control may be required in the above case. Because one type of sheets are generally contained in a sheet feeder 21, the sheet detector 14 may be configured to perform the detection condition setting procedure for a first sheet transported from the sheet feeder 21. The positions of following sheets may be detected based on the detection conditions set relative to the first sheet. Therefore, the complicated control may be unnecessary.

Alternatively, the sheet detector 14 may be configured to perform the detection condition setting procedure for a first sheet transported from the sheet feeder 21 after the image forming apparatus 100 illustrated in FIG. 1 is powered on.

In the case of the sheet conveyance unit 10 having a sheet set detector, the sheet detector 14 may be configured to perform the detection condition setting procedure for a first sheet transported from the sheet feeder 21 after the sheet set detector detects the sheet. In this case, the complicated control may be similarly unnecessary.

The sheet selection part 30 illustrated in FIGS. 7 and 8 are examples of the sheet type setter. In the case of the image forming apparatus having the sheet type setter, the sheet detector 14 may be configured to perform the detection condition setting procedure for a first sheet transported from the sheet feeder 21 after the type of sheet is changed with the sheet type setter.

Numerous additional modifications and variations are possible in light of the above teachings. It is therefore to be understood that within the scope of the appended claims, the disclosure of this patent specification may be practiced otherwise than as specifically described herein.

This patent specification is based on Japanese patent applications, No. JP2005-368849 filed on Dec. 21, 2005 in the Japan Patent Office, the entire contents of each of which are incorporated by reference herein.

What is claimed is:

1. A sheet detector mechanism comprising:

a sheet detector including, a light source emitting light, and a plurality of photoreceptors arranged in a line in a main-scanning direction spaced at substantially equal intervals to extend across a sheet skew marginal width and to evenly receive light from a light source, the plurality of photoreceptors including a first photoreceptor group overridable by a side edge of the sheet passing through a sheet conveyance passage and a second photoreceptor group connected to the first photoreceptor group and including an opposite end of the plurality of photoreceptors being out of the side edge of the sheet, the first photoreceptor group changing output voltages when overridden by the side edge of the sheet; and a controller configured to adjust a light emission amount of the light source in accordance with characteristics of the sheet so as to maintain the output voltages of the plurality of photoreceptors, regardless of the characteristics of the sheet.

2. The sheet detector mechanism of claim 1, wherein the light source and the plurality of photoreceptors form a transmissive type sheet detector, and the controller is further configured to previously store a threshold value and to determine the output voltages of the plurality of photoreceptors as detecting the sheet when the output voltages are equal to or smaller than the threshold value.

3. The sheet detector mechanism of claim 1, wherein the light source and the plurality of photoreceptors form a reflection type sheet detector, and the controller is further configured to previously store a threshold value and to determine the output voltages of the plurality of photoreceptors as detecting the sheet when the output voltages are equal to or greater than the threshold value.

4. The sheet detector mechanism of claim 1, wherein the controller configured to adjust a light emission amount of the light source in accordance with the characteristics of the sheet before sheet detection by the sheet detector so as to maintain the output voltages of the plurality of photoreceptors, regardless of the characteristics of the sheet.

5. The sheet detector mechanism according to claim 1, wherein the sheet detector performs a detection setting procedure while the sheet is kept motionless.

6. The sheet detector mechanism of claim 1, wherein the light source faces a first surface of the sheet and the photoreceptor part faces a second surface of the sheet when the sheet is conveyed to the sheet detector.

7. The sheet detector mechanism of claim 1, wherein the light source and the plurality of photoreceptors face a same surface of the sheet when the sheet is conveyed to the sheet detector.

8. An image forming apparatus, comprising:

a sheet conveyance mechanism configured to convey a sheet through a sheet conveyance passage;

an image forming mechanism configured to form an image and to transfer the image at an image transfer region onto the sheet conveyed by the sheet conveyance mechanism; and the sheet detector mechanism of claim 1, arranged upstream from the image transfer region in the sheet conveyance direction.

9. The image forming apparatus according to claim 8, wherein the sheet conveyance mechanism further comprises:

a sheet type setter to set a type of sheet;

and the sheet detector performs a detection setting procedure for a first sheet conveyed from the sheet conveyance mechanism after the sheet type is changed by the sheet type setter.

10. The image forming apparatus according to claim 8, wherein the sheet detector performs a detection setting procedure for a first sheet conveyed from the sheet conveyance mechanism.

11. The image forming apparatus according to claim 8, wherein the sheet detector performs a detection setting procedure for a first sheet conveyed from the sheet conveyance mechanism after the image forming apparatus is powered on.

12. The image forming apparatus according to claim 8, configured to be a multifunction peripheral including at least two functions selected from copying, printing, and facsimile functions.

13. The image forming apparatus of claim 8, wherein the controller is further configured to perform a sheet analysis test in which the controller controls the light source to sequentially emit the light by changing the light emission amount relative to the sheet passing through the sheet conveyance passage and determines the characteristics of the sheet based on the output voltages with respect to the changes of the light emission amount, and to adjust the light emission amount of the light source in accordance with a result of the sheet analysis test before a performance of a sheet detection by the sheet detector so as to maintain the output voltages of the plurality of photoreceptors, regardless of the characteristics of the sheet.

14. The image forming apparatus of claim 13, wherein the controller determines the characteristics of the sheet based on the output voltages with respect to the changes of the light emission amount by examining a relationship $(Z+\Delta Z)\square X\square(Z-\Delta Z)$, where Z is a center value of a predetermined expected output voltage range, $\Delta Z$ is an allowance value, and X is an actual output voltage, wherein the controller adjusts the light emission amount of the light source in accordance with a difference between X and Z.

* * * * *